US008857743B2

(12) United States Patent
Shingu et al.

(10) Patent No.: US 8,857,743 B2
(45) Date of Patent: Oct. 14, 2014

(54) FUEL INJECTION VALVE

(75) Inventors: Akio Shingu, Chiyoda-ku (JP); Masayuki Aota, Chiyoda-ku (JP); Tsuyoshi Munezane, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 1274 days.

(21) Appl. No.: 12/276,547

(22) Filed: Nov. 24, 2008

(65) Prior Publication Data

US 2009/0288640 A1 Nov. 26, 2009

(30) Foreign Application Priority Data

May 22, 2008 (JP) ..... 2008-134506

(51) Int. Cl.
*B05B 1/30* (2006.01)
*F02M 51/06* (2006.01)

(52) U.S. Cl.
CPC ..... *F02M 51/0685* (2013.01); *F02M 51/0671* (2013.01)
USPC ..... 239/585.1; 239/585.5

(58) Field of Classification Search
CPC ..... F02M 59/466; F02M 51/0621; F02M 51/066; F02M 51/0653
USPC ..... 239/88, 89, 95, 533.2, 533.9, 533.12, 239/585.1, 585.2, 585.3, 585.4, 584
See application file for complete search history.

(56) References Cited

U.S. PATENT DOCUMENTS

| | | | | |
|---|---|---|---|---|
| 4,749,892 | A | 6/1988 | Mesenich | |
| 5,544,816 | A * | 8/1996 | Nally et al. | 239/585.5 |
| 6,264,116 | B1 * | 7/2001 | Harcombe et al. | 239/124 |
| 6,279,873 | B1 | 8/2001 | Eichendorf et al. | |
| 6,367,769 | B1 | 4/2002 | Reiter | |
| 6,405,947 | B2 * | 6/2002 | Fochtman | 239/585.4 |
| 6,520,421 | B2 * | 2/2003 | Dallmeyer et al. | 239/5 |
| 7,870,847 | B2 * | 1/2011 | Eisenmenger | 123/446 |
| 2003/0155440 | A1 | 8/2003 | Reiter | |

FOREIGN PATENT DOCUMENTS

| | | | |
|---|---|---|---|
| DE | 33 14 899 | A1 | 10/1984 |
| DE | 198 16 315 | A1 | 10/1999 |
| DE | 198 49 210 | A1 | 4/2000 |
| DE | 101 08 974 | A1 | 9/2002 |
| DE | 10 2006 049 253 | A1 | 4/2008 |

(Continued)

OTHER PUBLICATIONS

German Office Action, dated Oct. 28, 2013, issued in counterpart German Patent Application No. 10 2008 043 868.5.

*Primary Examiner* — Davis Hwu

(74) *Attorney, Agent, or Firm* — Sughrue Mion, PLLC

(57) ABSTRACT

The objective of the present invention is to realize the structure, of a fuel injection valve, in which bouncing of the needle can be suppressed and the armature position can be fixed while the valve is closed, without increasing the number of components and the number of processes. In a fuel injection valve including an armature that is repelled or attracted by a core, by de-energizing or energizing a coil, a needle that opens or closes a valve seat in accordance with a reciprocal travel of the armature, and a valve-closing spring that biases the needle so as to close the valve, when the coil is de-energized, the valve-closing spring is disposed on the armature, and the needle and the armature are fixed in such a way that the armature can travel in an axis direction by a predetermined amount with respect to the needle.

8 Claims, 6 Drawing Sheets

(56) References Cited

FOREIGN PATENT DOCUMENTS

| | | | |
|---|---|---|---|
| FR | 2 544 801 | A1 | 10/1984 |
| JP | 2002-506502 | | 2/2002 |
| JP | 2004-521269 | A | 7/2004 |
| JP | 2005-171845 | A | 6/2005 |
| JP | 2006-017101 | | 1/2006 |
| JP | 2009191687 | A | 8/2009 |
| WO | 99/53189 | | 10/1999 |

* cited by examiner (a)

(b)

FUEL INJECTION VALVE

BACKGROUND OF THE INVENTION

1. Field of the Invention

The present invention relates to a fuel injection valve for an internal combustion engine and particularly to improvement of an electromagnetic fuel injection valve utilized in a fuel supply system in an internal combustion engine.

2. Description of the Related Art

The typical configuration of a fuel injection valve of this kind will be explained with reference to FIG. 1. As illustrated in FIG. 1, a fuel injection valve 1 is configured mainly with a solenoid device 2 and a valve device 12. The solenoid device 2 is configured with a housing 3 that is a yoke portion of a magnetic circuit, a core 4 that is a fixed iron core portion of the magnetic circuit, a coil 5 energized from outside via a connector 6, an armature 7 that is a moving iron core portion of the magnetic circuit, and a valve-closing spring 9 that biases a needle 8 coupled with the armature 7 downstream. In addition, a fuel is supplied through a fuel inlet 10 situated at the upper portion of the fuel injection valve 1, and injected through a valve seat 15; The side of the fuel inlet 10 is referred to as "an upstream side", and the side of the valve seat 11 referred to as "a downstream side".

The valve device 12 is configured with a hollow body 13 that is coupled with the housing 3 and contains part of the core 4 and the armature 7, the needle 8 that is disposed inside the body 13 and coupled with the armature 7, a guide 14 that is provided at the downstream side of the body 13 and guides the slide of the needle 8, and the valve seat 15 that controls a fuel flow by detaching or attaching the needle 8 thereby opening or closing an injection nozzle 15A. The operation of the foregoing fuel injection valve 1 is well known; thus, the explanation therefor will be omitted.

The detail of the configuration of the conventional fuel injection valve 1 will be explained below with reference to FIGS. 5 to 7 each of which is a partial enlarged view of the solenoid device 2 and the valve device 12. In the typical conventional fuel injection valve 1, as illustrated in FIG. 5, the armature 7 and the needle 8 are integrated by means of welding, press fitting, or the like; the armature 7 is pressed downstream by the valve-closing spring 9. However, as described above, the typical conventional fuel injection valve 1 employs an electromagnet-driving method in which the coil 5 is energized; therefore, due to energization or de-energization of the coil 5, travel members move up and down. The vertical movement causes the armature to collide with the core 4 or causes the needle 8 to collide with the valve seat 15; as a result, the impact of the collision causes the travel members to bounce, whereby the amount of fuel injection cannot accurately be controlled.

In order to cope with the problem of bouncing, as illustrated in FIGS. 6 and 7, there is suggested a fuel injection valve in which the needle 8 and the armature 7 are separated from each other. The fuel injection valve illustrated in FIG. 6 is configured in the following manner:

The upstream end of the needle 8 penetrates the armature 7, and the front end of the needle 8 is fixed in a stopper 16 by means of welding or the like; as the result, an elastic member 17, such as a spring, is inserted between the needle 8 (the stopper 18) and the armature 7, and the upper portion of the stopper 16 is pressed by the valve-closing spring 9 in such a way that the needle 8 and the armature 7 are pressed downstream. Because the existence of the elastic member 17 enables the armature 7 to travel in the axis direction by a predetermined amount with respect to the needle 8, an impact force caused by a collision is relaxed (e.g., refer to National Publication of International Patent Application No. 2002-506502).

Additionally, as is the case with the fuel injection valve illustrated in FIG. 6, the fuel injection valve illustrated in FIG. 7 is configured in such a way that the needle 8 and the armature 7 are separated; however, the fuel injection valve illustrated in FIG. 7 is further configured in such a way that, instead of inserting the elastic member 17, such as a spring, between the armature 7 and the stopper 16, a predetermined gap is formed between the stepped portion 19 of the needle 8 and the bottom end 21 of the armature 7 when the stopper 16 and the top end 20 of the armature 7 make contact with each other.

Assuming that the armature 7 is attracted by the core 4 to collide with the core 4, the impact of the collision causes the armature 7 to rebound; however, the needle 8 tends to further travel toward the core 4, due to the inertia of upward movement. In other words, because the respective directions of the energy of the armature 7 and the energy of the needle 8 are opposite to each other, the energies caused by the collision can be cancelled, by allowing the relative travel between the armature 7 and the needle 8 by means of the gap between the stepped portion 19 of the needle 8 and the bottom end 21 of the armature 7 (e.g., refer to Japanese Patent Laid-Open Pub. No. 2006-17101).

However, there has been a problem that the number of components and the number of processes considerably increase in such a structure, as disclosed in National Publication of International Patent Application No. 2002-506502, in which the armature 7 and the needle 8 are coupled with each other by means of the elastic member 17 such as a spring, whereby the structure becomes complex. Additionally, in the case of such a structure as disclosed in Japanese Patent Laid-Open Pub. No. 2006-17101, due to the existence of the gap between the stepped portion 19 of the needle 8 and the bottom end 21 of the armature 7, the position of the armature 7 cannot be fixed; therefore, there has been a problem that the vibration of the internal combustion engine or the like causes the distance between the armature 7 and the core 4 to be unstable while the valve is closed, whereby the time required to open the valve fluctuates and the accuracy of an injection amount is deteriorated.

SUMMARY OF THE INVENTION

A fuel injection valve according to the present invention has been implemented in order to solve the foregoing problems; the objective thereof is to realize the structure, of a fuel injection valve, in which, without increasing the number of components and the number of processes, bouncing of the needle can be suppressed and the armature position can be fixed while the valve is closed, and thereby to raise the accuracy of the linearity of an injection amount and the accuracy of an injection amount.

A fuel injection valve according to the present invention is provided with an armature that is repelled or attracted by a core, by de-energizing or energizing a coil; a needle that opens or closes a valve seat in accordance with a reciprocal travel of the armature; and a valve-closing spring that biases the needle so as to close the valve, when the coil is de-energized. The valve-closing spring is disposed on the armature, and the needle and the armature are fixed in such a way that the armature can travel in an axis direction by a predetermined amount with respect to the needle.

According to the present invention, an effect is demonstrated in which the responsiveness at the time when the valve is opened can be raised, and bouncing of the needle at the time when the valve is opened can be suppressed with a simple structure, without increasing the number of components.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Embodiment 1

Figure 1:
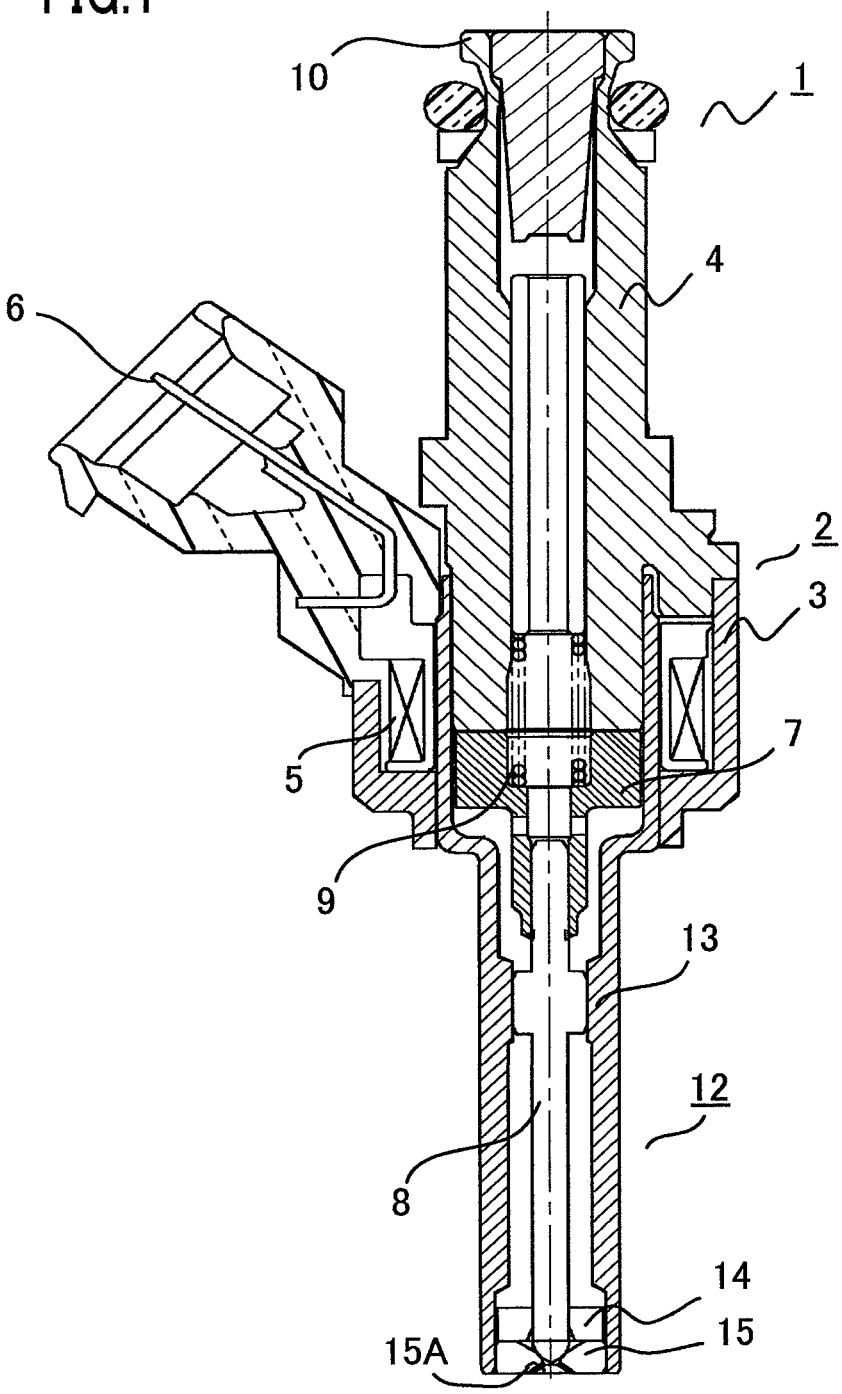
FIG. 1 is an overall schematic configuration diagram of a fuel injection valve for an internal combustion engine, according to the present invention.
Figure 2:
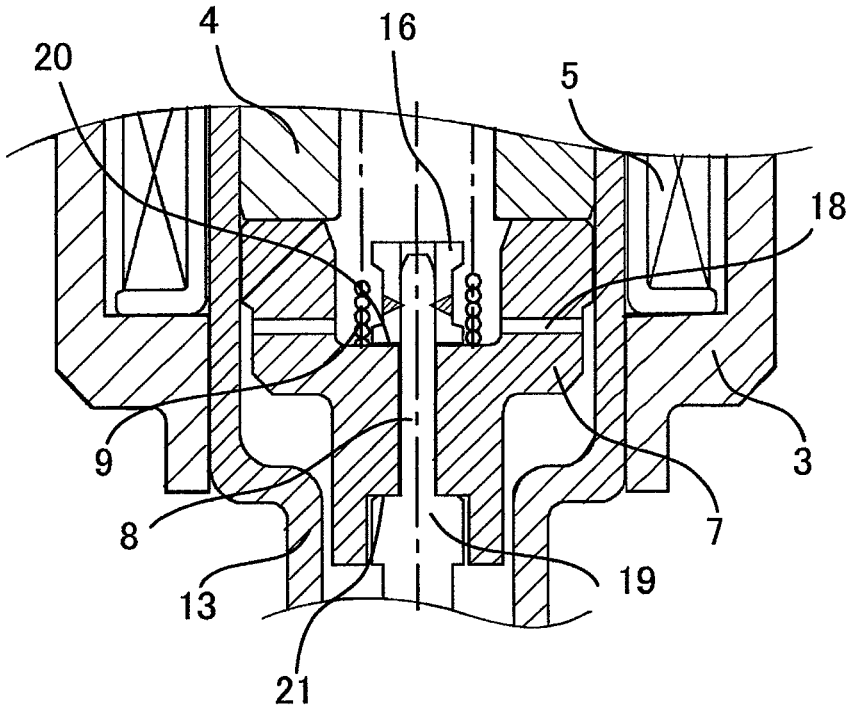
FIG. 2 is a partial enlarged configuration diagram of a fuel injection valve according to Embodiment 1 of the present invention.

Embodiment 1 of the present invention will be explained below. FIG. 2 illustrates the detail of the configuration of a fuel injection valve 1 according to Embodiment 1, while partially enlarging a solenoid device 2 and a valve device 12. In FIG. 2, a stepped portion 19 is provided on the side surface of a needle 8, an armature 7 is put on the upstream side of the stepped portion 19 in such a way as to be penetrated by the needle 8, and the front end of the needle 8 is fixed in a stopper 16 by means of welding or the like; on that occasion, the front end of the needle 8 is press-fitted and welded in the stopper 16, while adjusting the stopper 16 in such a way that the armature 7 can travel by a predetermined amount with respect to the needle 8. Additionally, by making a valve-closing spring 9 make contact with the top end 20 of the armature 7, the armature 7 and, eventually, the needle 8 are pressed downstream so that the needle and a valve seat 15 perform a valve-closing operation. In addition, the armature 7 has a through-hole 18 as a fuel path; the through-hole 18 has a flow-path area large enough for an injection amount so that it does not become a flow-path neck portion.

Figure 3:
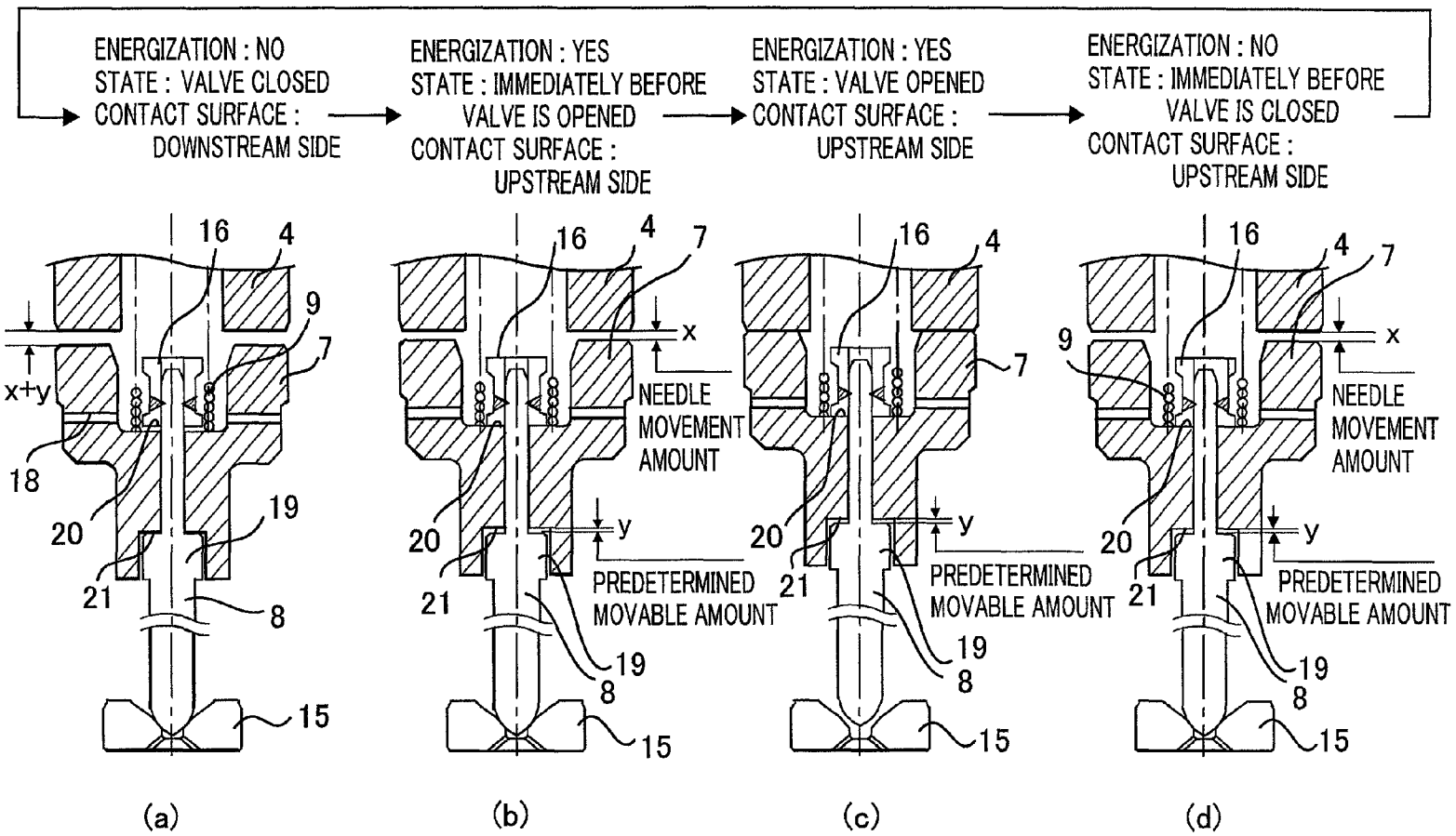
FIG. 3 is a set of diagrams for explaining a fuel injection valve according to Embodiment 1 of the present invention.

The operation of the fuel injection valve 1 according to Embodiment 1 will be explained below with reference to FIG. 3. FIG. 3(*a*) illustrates a valve-closing state in which a coil 5 is not energized; when the front end of the needle 8 is welded in the stopper 16, the distance between the armature 7 and the needle 8 is set in such a way that the armature and the needle 8 can travel in the axis direction by a predetermined amount with respect to each other. At the timing immediately before energization is performed, the valve-closing spring 9 presses the armature 7 so that, as illustrated in FIG. 3(*a*), a valve-closing state is maintained in which a downstream contact surface 21 of the armature 7 always makes contact with the needle 8.

FIG. 3(*b*) illustrates a state in which energization has been started and the valve has almost been opened. After the energization, firstly, only the armature 7 is attracted by the core 4, due to an electromagnetic force; as illustrated in FIG. 3(*b*), the upstream contact surface 20 of the armature 7 collides with the bottom end surface of the stopper 16; then, the armature 7 and the needle 8 are integrated with each other, whereupon the valve is opened. As a result, the needle 8 can travel (a needle travel amount: x) while the armature 7 has an initial velocity; therefore, the valve-opening speed and the responsiveness are raised, whereby the accuracy of an injection amount is improved. In the foregoing state, a gap y described later is formed between the bottom end surface 21 of the armature 7 and the top end surface of the stepped portion 19 of the needle 8; in the gap y, the armature 7 can travel by a predetermined amount with respect to the needle 8.

FIG. 3(*c*) illustrates a state in which energization is performed and the valve is opened; there is illustrated a state in which the armature 7 and the core 4 collide with each other after the valve-opening operation has advanced from the state in FIG. 3(*b*). When the collision occurs, the impact of the collision causes only the armature 7 to rebound downstream; in contrast, because an inertial force is exerted on the needle 8, it remains moving and overshoots upstream. In this situation, when the sum of the amount of bouncing of the armature 7 and the amount of overshooting of the needle 8 becomes equal to the predetermined amount y by which the armature 7 can travel with respect to the needle 8, the armature 7 and the needle 8, having respective forces opposite to each other, collide with each other at the downstream contact surface 21, whereby the movement of the armature 7 and the movement of the needle 8 cancel each other; therefore, the needle 8 can be suppressed from bouncing when the valve is opened, whereby the accuracy of the linearity of an injection amount can be prevented from being deteriorated by the bouncing.

FIG. 3(*d*) illustrates a state in which energization has been interrupted again and the armature 7 is biased downstream by the valve-closing spring 9, i.e., a state at the timing immediately before the valve is closed. In this situation, the valve-closing spring 9 directly biases the armature 7 downstream, and the needle 8 bounces due to its collision with the valve seat 15; however, because there exists the gap, between the bottom end surface 21 of the armature 7 and the stepped portion 19, having the predetermined amount by which the armature can travel with respect to the needle 8, the bouncing of the needle 8 and the inertial force exerted on the armature 7 cancel each other. Moreover, because the fuel injection valve is configured in such a way that the valve-closing spring 9 presses the armature 7, the valve-closing state can be maintained; therefore, unlike the fuel injection valve disclosed in Japanese Patent Laid-Open Pub. No. 2006-17101, the armature 7 does not readily travel in the axis direction by a vibration or the like, whereby the accuracy of an injection amount is not deteriorated.

As can be seen from the foregoing explanation, in the fuel injection valve according to Embodiment 1 of the present invention, the responsiveness at the time when the valve is opened can be raised and the bouncing of the needle 8 at the time when the valve is opened can be suppressed with a simple structure, without causing the number of components to increase. In particular, the gap of a predetermined amount is disposed in such a way that, when the needle is fixed in the stopper 16, the front end of the needle 8 is press-fitted and welded in the stopper 16, while adjusting the stopper 16 in such a way that the armature 7 can travel by the predetermined amount with respect to the needle 8; therefore, the setting of the gap is extremely simplified. In addition, the value of the predetermined amount by which the armature 7 can travel with respect to the needle 8 is set to be the same as or smaller than 10% of the overall travel amount of the needle 8, so that the bouncing amount of the needle 8 does not affect the accuracy of the linearity of an injection amount.

Embodiment 2

In a direct-injection internal combustion engine, in order to expand the injection range or to atomize the spray, the injection fuel is pressurized. Due to the fuel pressure caused by the pressurization, a force exerted on the needle 8 is enlarged; therefore, there has been a problem that, when the needle 8 is seated in the valve seat 15, the collision load increases and thereby the needle 8 and the seating surface of the valve seat 15 wear out, whereby the durability is deteriorated.

In order to cope with the foregoing problem, the fuel injection valve is configured in such a way as to have the relation given by Equation (1) below in a time period during which the needle 8 starts valve closing and then is seated in the valve seat 15, so that the needle 8 has a valve-opening speed faster than that of the armature 7, and as illustrated in FIG. 3(*d*), the needle 8 is seated in the valve seat 15, with the armature 7 and the needle 8 left in contact with each other at the upstream contact end 20.

$$\frac{F_n}{M_n} > \frac{F_s - F_m}{M_a} \tag{1}$$

where Fn is a force on the needle 8 exerted by the fuel pressure, Fs is a force with which the valve-closing spring 9 presses the armature 7, Fm is a force on the armature 7 exerted by a residual magnetic field, Mn is the mass of the needle 8, and Ma is the mass of the armature 7.

As a result, because Fs is not included in the collision load, the wear of the needle 8 and the seating surface of the valve seat 15 is suppressed, whereby the durability can be raised.

Moreover, when the needle 8 is seated in the valve seat 15, with the armature 7 and the needle 8 left in contact with each other at the upstream contact end 20, the needle 8 collides with the valve seat 15 and bounces upstream; however, the armature 7 overshoots downward due to the pressing force exerted by the valve-closing spring 9 and the inertial force. In this situation, when the sum of the amount of bouncing of the needle 8 and the amount of overshooting of the armature 7 becomes equal to the predetermined amount by which the armature 7 can travel with respect to the needle 8, the armature 7 and the needle 8, having respective forces opposite to each other, collide with each other at the downstream contact surface 21, whereby the movement of the armature 7 and the movement of the needle 8 cancel each other; therefore, by suppressing also the bouncing of the needle 8 when the valve is closed, the second injection spray, which is not readily atomized, can be prevented from occurring.

In addition, in the case where Fm (a force on the armature 7 exerted by a residual magnetic field) is negligible, the fuel injection valve is configured in such a way as to have a relation given by Equation (2) below, so that, as is the case with Equation (1), the collision load at the timing when the needle 8 and the valve seat 15 collide with each other can be reduced, whereby the wear of the needle 8 and the seating surface of the valve seat 15 can be suppressed and the durability thereof can be raised.

$$\frac{F_n}{M_n} \geq \frac{F_s}{M_a} \tag{2}$$

In an internal combustion engine utilizing a variable fuel pressure system, a structure that satisfies Equation (1) or Equation (2) in the whole range of the system fuel pressure largely deteriorates the configuration flexibility of the fuel injection valve 1, and poses a problem of deterioration in the valve-closing speed in the case where the fuel pressure is low, i.e., in the case where Fn is small. Accordingly, the fuel injection valve is configured in such a way as to satisfy Equation (1) or Equation (2), only in a part of the variable fuel pressure range, i.e., only in a high fuel pressure range in which the wear of the needle 8 and the seating surface of the valve seat 15 becomes large, that is to say, only in the case where Fn is large. In this situation, in the case of a low fuel pressure with which Fn is small, the fuel injection valve is configured in such a way that Equation (3) below is satisfied, so that the needle 8 is seated in the valve seat 15, with the armature 7 and the needle 8 kept in contact with each other at the downstream contact surface 21, and the force exerted on the needle 8 becomes Fn+Fs, whereby the deterioration in the valve-closing speed can be prevented. As a result, suppression of the wear of the needle 8 and the seating surface of the valve seat 15 and prevention of the deterioration in the valve-closing speed can concurrently be performed.

$$\frac{F_s}{M_a} > \frac{F_n}{M_n} \tag{3}$$

Embodiment 3

Figure 4:
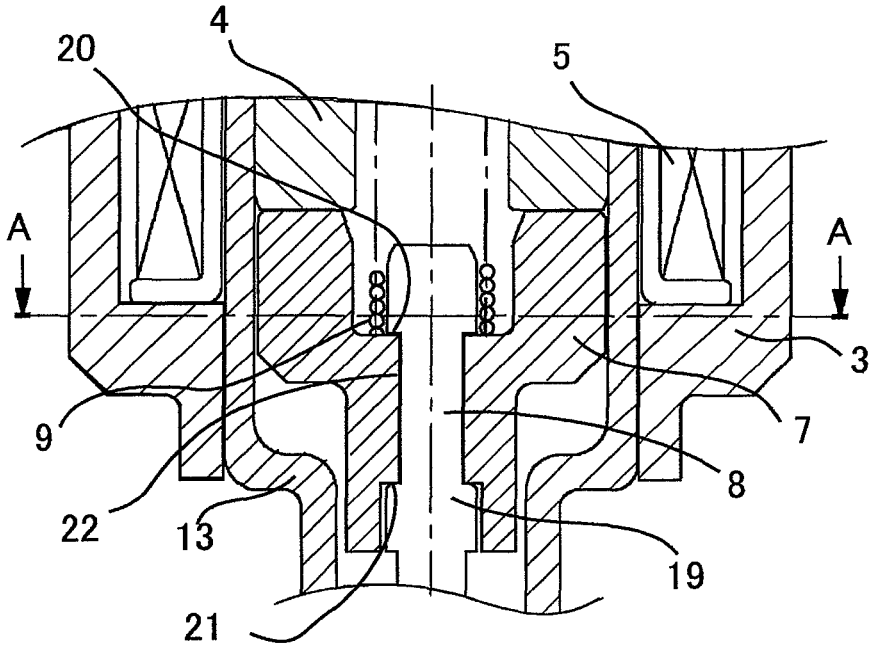
FIG. 4 is a partial enlarged configuration diagram of a fuel injection valve according to Embodiment 3 of the present invention.
Figure 4:
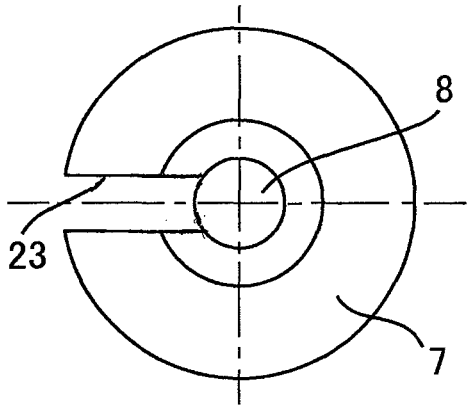
Figure 5:
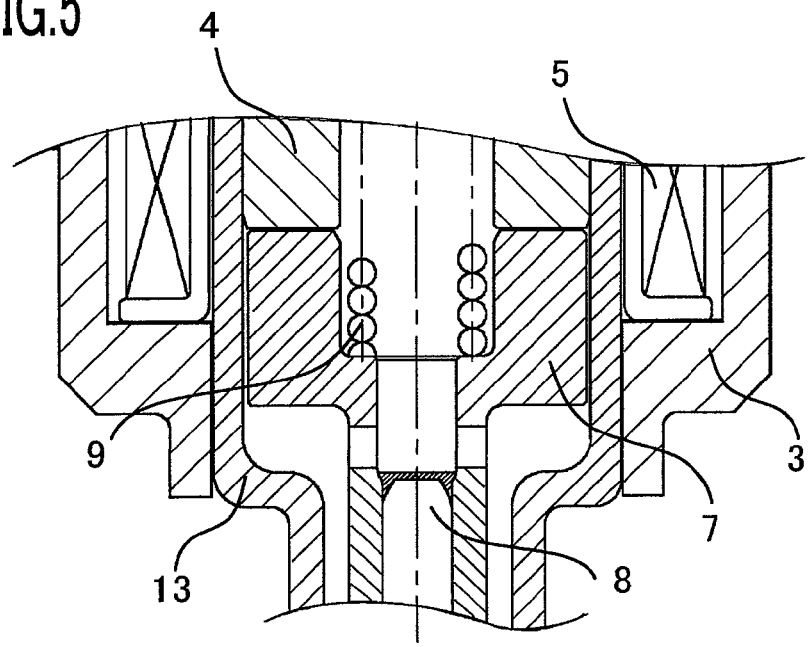
FIG. 5 is a partial enlarged configuration diagram illustrating an embodiment for a conventional fuel injection valve.
Figure 6:
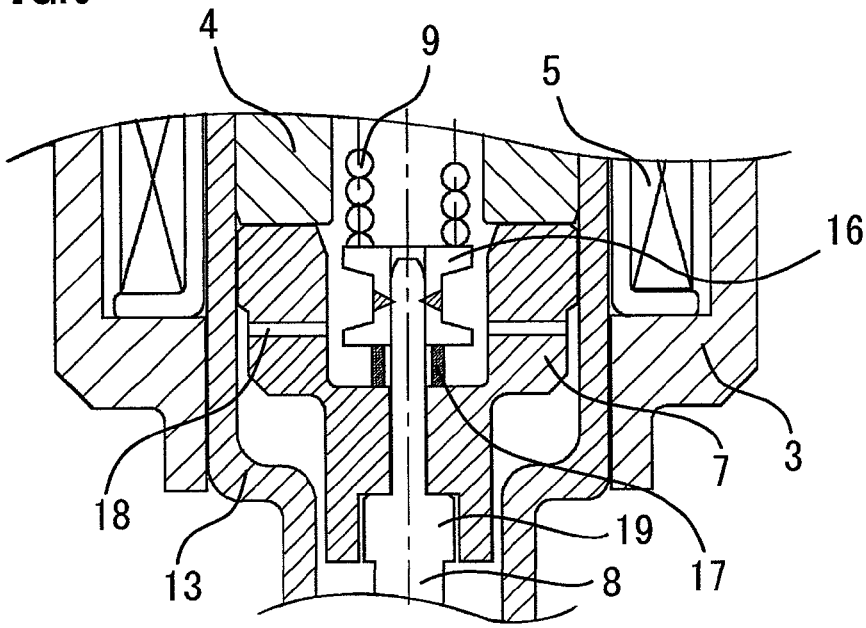
FIG. 6 is a partial enlarged configuration diagram illustrating another embodiment for a conventional fuel injection valve.
Figure 7:
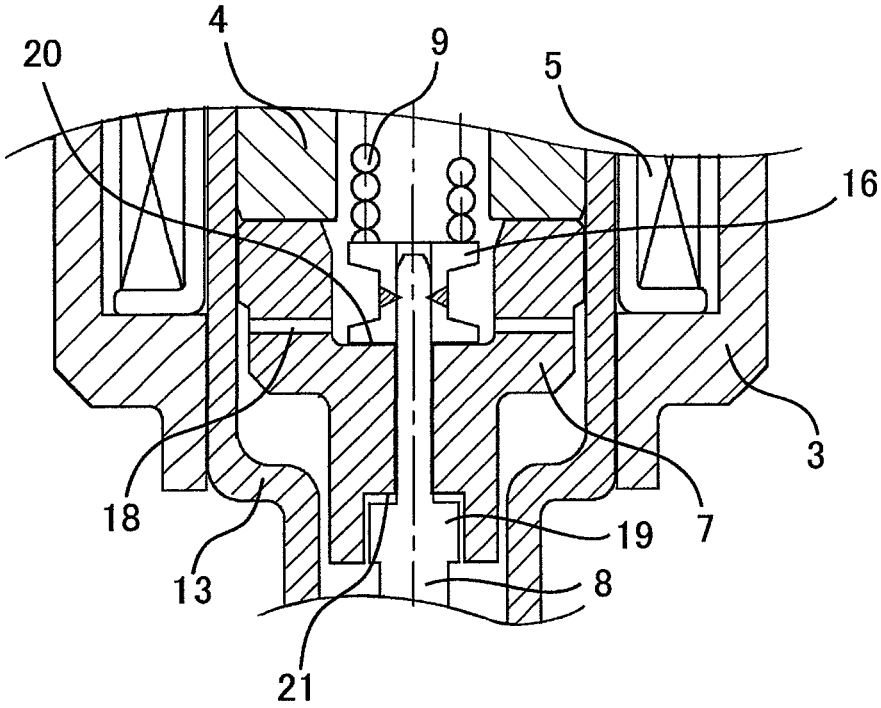
FIG. 7 is a partial enlarged configuration diagram illustrating further another embodiment for a conventional fuel injection valve.

FIG. 4 illustrates the detail of the configuration of a fuel injection valve 1 according to Embodiment 3. In FIG. 4, FIG. 4(*b*) is a cross-sectional view taken along the line A-A in the FIG. 4(*a*) Embodiment 2 differs from Embodiment 1 only in the method of fixing the needle 8 and the armature 7. That is to say, in FIG. 2, the stepped portion 19 is provided on the side surface of the needle 8, the armature 7 is put on the upstream side of the stepped portion 19 in such a way as to be penetrated by the needle 8, and the front end of the needle 8 is fixed in the stopper 16 by means of welding or the like; however, in FIG. 4, the fuel injection valve has a structure in which, in the side surface of the needle 8, there is provided a groove 22 whose top and bottom end surfaces make contact with the top end surface 20 and the bottom end surface 21, respectively, of the armature 7, the armature 7 is shaped in such a way as to have a slit 23 (refer to FIG. 4(*b*)) in a portion thereof, and a C-shaped armature 7 is inserted in the needle 8 through the slit 23.

As a result, it is only necessary to simply insert the C-shaped armature 7 in the needle 8; therefore, the stopper 16 for forming the top end surface 20 of the armature 7 is not required, whereby the number of components and the number of processes can be decreased. Moreover, because the armature 7 has a C-shape, the fuel path can readily be ensured and the flexibility of the shape of the magnetic path is enlarged.

Various modifications and alterations of this invention will be apparent to those skilled in the art without departing from the scope and spirit of this invention, and it should be understood that this is not limited to the illustrative embodiments set forth herein.

What is claimed is:

1. A fuel injection valve comprising:

an armature that is repelled or attracted by a core, by de-energizing or energizing a coil;

a needle that opens or closes a valve seat in accordance with a reciprocal travel of the armature; and a valve-closing spring that biases the needle so as to close the valve, when the coil is de-energized, wherein the valve-closing spring is disposed on the armature, and the needle and the armature are fixed in such a way that the needle can travel independently of the armature in an axis direction by a predetermined amount, and wherein a stepped portion is provided at a side surface of the needle, part of an end surface of the armature makes contact with the stepped portion, a stopper is provided in such a way that the armature is inserted between the stopper and the stepped portion, and the needle is press-fitted and welded in the stopper.

2. The fuel injection valve according to claim 1, wherein, in a time period during which the needle starts valve closing and then is seated in the valve seat, a relationship among a force Fn on the needle exerted by a fuel pressure, a force Fs with which the valve-closing spring presses the armature, a force Fm on the armature exerted by a residual magnetic field, the mass Mn of the needle, and the mass Ma of the armature satisfies Equation (1) below $$\frac{F_n}{M_n} > \frac{F_s - F_m}{M_a}. \quad (1)$$

3. The fuel injection valve according to claim 1, wherein, in a time period during which the needle starts valve closing and then is seated in the valve seat, a relationship among a force Fn on the needle exerted by a fuel pressure, a force Fs with which the valve-closing spring presses the armature, the mass Mn of the needle, and the mass Ma of the armature satisfies Equation (2) below $$\frac{F_n}{M_n} \geq \frac{F_s}{M_a}. \quad (2)$$

4. The fuel injection valve according to claim 2, wherein, in an internal combustion engine utilizing a variable fuel pressure system, Equation (1) is satisfied only in a high fuel pressure range out of a variable fuel pressure range.

5. The fuel injection valve according to claim 3, wherein, in an internal combustion engine utilizing a variable fuel pressure system, Equation (2) is satisfied only in a high fuel pressure range out of a variable fuel pressure range.

6. The fuel injection valve according to claim 1, wherein the predetermined amount by which the armature can travel in the axis direction with respect to the needle is the same as or smaller than 10% of an overall travel amount of the needle.

7. The fuel injection valve according to claim 1, wherein a groove portion is provided in the side surface of the needle, and a C-shaped armature having a slit portion is inserted into the groove portion of the side surface of the needle.

8. A fuel injection valve comprising:

an armature that is repelled or attracted along an axis of a core, by de-energizing or energizing a coil;

a needle that opens or closes a valve seat in accordance with a reciprocal travel of the armature; and a valve-closing spring that biases the needle so as to close the valve, when the coil is de-energized, wherein the valve-closing spring is disposed on the armature, and the needle and the armature are movably fixed to each other so that the needle can travel independently of the armature in an axis direction by a predetermined amount.

* * * * *